US008696437B2

(12) United States Patent
Anderson et al.

(10) Patent No.: US 8,696,437 B2
(45) Date of Patent: Apr. 15, 2014

(54) GAMING SYSTEM HAVING BONUS BOOSTER FEATURES

(75) Inventors: Peter R. Anderson, Glenview, IL (US); Shridhar P. Joshi, Naperville, IL (US); Philip B. Gelber, Glen Ellyn, IL (US); Michael W. Mastropietro, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 815 days.

(21) Appl. No.: 12/670,326

(22) PCT Filed: Jul. 15, 2008

(86) PCT No.: PCT/US2008/008601

§ 371 (c)(1),
(2), (4) Date: Jan. 22, 2010

(87) PCT Pub. No.: WO2009/017590

PCT Pub. Date: Feb. 5, 2009

(65) Prior Publication Data

US 2010/0227666 A1 Sep. 9, 2010

Related U.S. Application Data

(60) Provisional application No. 60/962,506, filed on Jul. 30, 2007.

(51) Int. Cl.
*A63F 9/24* (2006.01)
*G06F 17/00* (2006.01)

(52) U.S. Cl.
USPC ..... 463/20; 463/27; 463/29; 463/25; 463/18

(58) Field of Classification Search
USPC ..... 463/19, 20, 25, 30
See application file for complete search history.

(56) References Cited

U.S. PATENT DOCUMENTS 5,393,061 A 2/1995 Manship et al. ..... 463/20
5,494,287 A 2/1996 Manz ..... 273/143
5,542,669 A 8/1996 Charron et al. ..... 463/13

(Continued)

FOREIGN PATENT DOCUMENTS

AU 774435 C 8/2001

OTHER PUBLICATIONS

International Preliminary Report on Patentability corresponding to PCT International Application No. PCT/US2008/008601, dated Feb. 2, 2010; 6 pages.

(Continued)

*Primary Examiner* — Paul A D'Agostino
(74) *Attorney, Agent, or Firm* — Nixon Peabody LLP

(57) ABSTRACT

A gaming system comprises a wager input device for receiving a primary wager, a display for displaying a primary wagering game, and a controller operative to (i) detect receipt of the primary wager, (ii) cause the display to present a randomly selected outcome of the primary wagering game, the randomly selected outcome selected from a plurality of possible outcomes, the plurality of possible outcomes including at least one winning outcome, (iii) determine if the randomly selected outcome is the at least one winning outcome, (iv) determine if the at least one winning outcome satisfies a booster eligibility requirement, (v) in response to the randomly selected outcome being the at least one winning outcome, provide a first award, and (vi) in response to the at least one winning outcome satisfying the booster eligibility requirement, provide a second award.

20 Claims, 14 Drawing Sheets

(56) References Cited

U.S. PATENT DOCUMENTS

| | | | | |
|---|---|---|---|---|
| 5,851,147 | A | 12/1998 | Stupak et al. | 463/13 |
| 5,902,184 | A | 5/1999 | Bennett | 463/13 |
| 6,146,273 | A * | 11/2000 | Olsen | 463/27 |
| 6,663,487 | B1 | 12/2003 | Ladner | 463/13 |
| 6,712,693 | B1 | 3/2004 | Hettinger | 463/20 |
| 6,843,724 | B2 | 1/2005 | Walker et al. | |
| 6,960,134 | B2 | 11/2005 | Hartl et al. | |
| 7,331,863 | B2 | 2/2008 | Baerlocher | 463/20 |
| 7,520,807 | B2 | 4/2009 | Muskin | 463/13 |
| 7,597,621 | B2 | 10/2009 | Baerlocher | 463/28 |
| 7,628,691 | B2 | 12/2009 | Luciano, Jr. et al. | 463/18 |
| 7,914,377 | B2 * | 3/2011 | Benbrahim et al. | 463/25 |
| 8,113,947 | B2 * | 2/2012 | Hornik et al. | 463/25 |
| 2001/0009865 | A1 | 7/2001 | Demar et al. | |
| 2003/0027623 | A1 * | 2/2003 | Rose | 463/20 |
| 2004/0142740 | A1 * | 7/2004 | Damico et al. | 463/20 |
| 2004/0242319 | A1 * | 12/2004 | Walker et al. | 463/25 |
| 2005/0009601 | A1 * | 1/2005 | Manfredi et al. | 463/29 |
| 2005/0064924 | A1 * | 3/2005 | Glavich et al. | 463/13 |
| 2005/0096121 | A1 * | 5/2005 | Gilliland et al. | 463/20 |
| 2006/0040733 | A1 * | 2/2006 | Baerlocher et al. | 463/26 |
| 2006/0068880 | A1 * | 3/2006 | Cannon | 463/18 |
| 2006/0079319 | A1 * | 4/2006 | Aoki et al. | 463/25 |
| 2007/0054733 | A1 * | 3/2007 | Baerlocher | 463/27 |
| 2007/0265060 | A1 * | 11/2007 | Hornik et al. | 463/20 |

OTHER PUBLICATIONS

Written Opinion corresponding to PCT International Application No. PCT/US2008/008601, dated Oct. 22, 2008; 5 pages.

PCT International Search Report for International Application No. PCT/US2008/008601 dated Apr. 29, 2009 (2 pages).

* cited by examiner

380

Pay Table

| Configuration 382a | Award 384a | Bonus Booster Activated |
|---|---|---|
| 7 7 7 7 | 250 Credits | ✓ |
| 🍒 🍒 🍒 | 100 Credits | |
| 7 7 7 | 60 Credits | ✓ |
| 🍒 🍒 🍒 | 50 Credits | |

382 384 386

FIG. 5

390a

| Bonus Booster Credit Table | | |
|---|---|---|
| Weight | Credit | Percentage % |
| 6 | 0 | 50% |
| 3 | 15 | 25% |
| 2 | 10 | 12.5% |
| 1 | 20 | 6.25% |

392a 394a 396a

FIG. 6A

390b

| Bonus Booster Multiplier Table | | |
|---|---|---|
| Weight | Multiplier | Percentage % |
| 6 | 1.0 | 50% |
| 3 | 1.5 | 25% |
| 2 | 2.0 | 12.5% |
| 1 | 3 | 6.25% |

392b 394b 396b

FIG. 6B

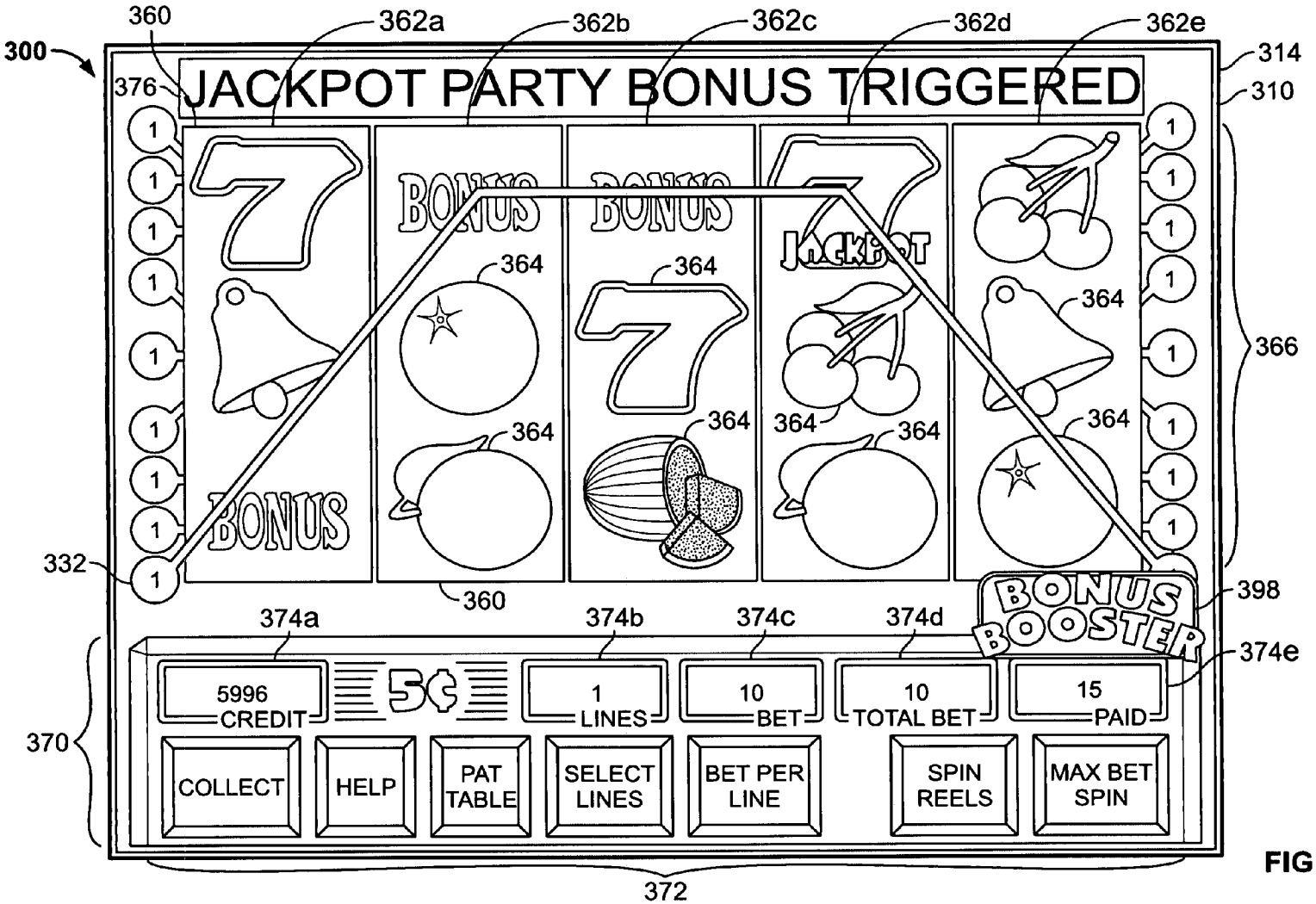
JACKPOT PARTY BONUS TRIGGERED
BONUS
BONUS
BONUS

GAMING SYSTEM HAVING BONUS BOOSTER FEATURES

CROSS REFERENCE TO RELATED APPLICATIONS

This application is a U.S. national stage filing of International Application No. PCT/2008/008601, filed Jul. 15, 2008, claiming priority from U.S. Provisional Application No. 60/962,506, filed Jul. 30, 2007, which are both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having one or more bonus booster features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, bonus games provided to supplement primary wagering games have been activated in response to bonus triggering outcomes achieved in the primary wagering game. One problem that arises is that an inherent predictability of the frequency and display of the bonus award occurs after repeated play of the wagering game. Another problem that occurs is that the amounts of bonus or secondary awards provided for certain bonus events triggered is fixed, causing the presentation of such awards to become repetitive and less exciting. Yet another problem with such traditional systems is that player's anticipation and excitement related to achieving bonus awards dissipates over repeated play of a wagering game, causing the game play experience to be less rewarding and thus, the game to be less desirable relative to other available wagering games. The present invention is directed to solving these and other problems.

SUMMARY OF THE INVENTION

According to one aspect of the present invention, a gaming system comprises a wager input device for receiving a primary wager, a display for displaying a primary wagering game, and a controller operative to (i) detect receipt of the primary wager, (ii) cause the display to present a randomly selected outcome of the primary wagering game, the randomly selected outcome selected from a plurality of possible outcomes, the plurality of possible outcomes including at least one winning outcome, (iii) determine if the randomly selected outcome is the at least one winning outcome, (iv) determine if the at least one winning outcome satisfies a booster eligibility requirement, (v) in response to the randomly selected outcome being the at least one winning outcome, provide a first award, and (vi) in response to the at least one winning outcome satisfying the booster eligibility requirement, provide a second award.

According to another aspect of the invention, a method of operating a wagering game comprises receiving a primary wager, and displaying a randomly selected outcome of a primary wagering game, the randomly selected outcome selected from a plurality of possible outcomes, the plurality of possible outcomes including at least one winning outcome. The method further comprises evaluating if the randomly selected outcome is the at least one winning outcome and evaluating if the at least one winning outcome satisfies a booster eligibility requirement. The method further comprises providing a first award in response to the randomly selected outcome being the at least one winning outcome, and providing a second award in response to the at least one winning outcome satisfying the booster eligibility requirement.

According to yet another aspect of the invention, a method of operating a wagering game comprises receiving a primary wager and displaying on a display a randomly selected outcome of a primary wagering game, the randomly selected outcome selected from a plurality of possible outcomes, the plurality of possible outcomes including at least one winning outcome. The method further comprises providing a first award in response to the randomly selected outcome being the at least one winning outcome, the first award associated with the at least one winning outcome in a first paytable of the wagering game. The method further comprises activating a bonus booster feature to provide a second award in response to the at least one winning outcome satisfying the booster eligibility requirement, the second award randomly selected from a second paytable of the wagering game.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5 is a paytable of the primary wagering game in which a bonus booster feature has been activated;

FIG. 6*a* is a bonus booster credit table for administering a bonus booster feature;

FIG. 6*b* is a bonus booster multiplier table for administering an alternative embodiment of a bonus booster feature;

FIG. 9 is a screen shot of a primary wagering game of an alternative embodiment of a gaming system including a bonus booster feature, depicting a bonus triggering outcome;

DETAILED DESCRIPTION

Figure 1A:
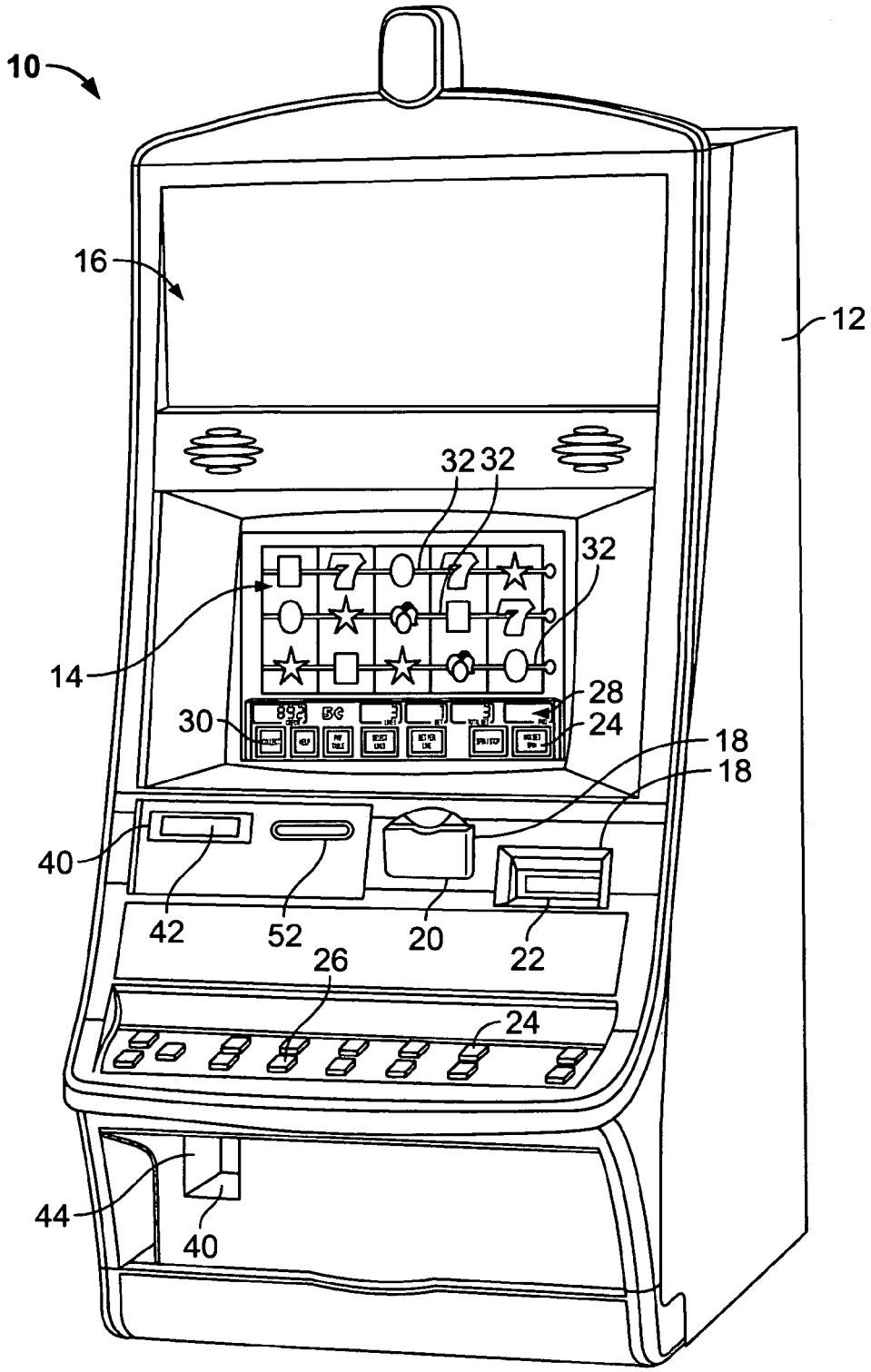
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
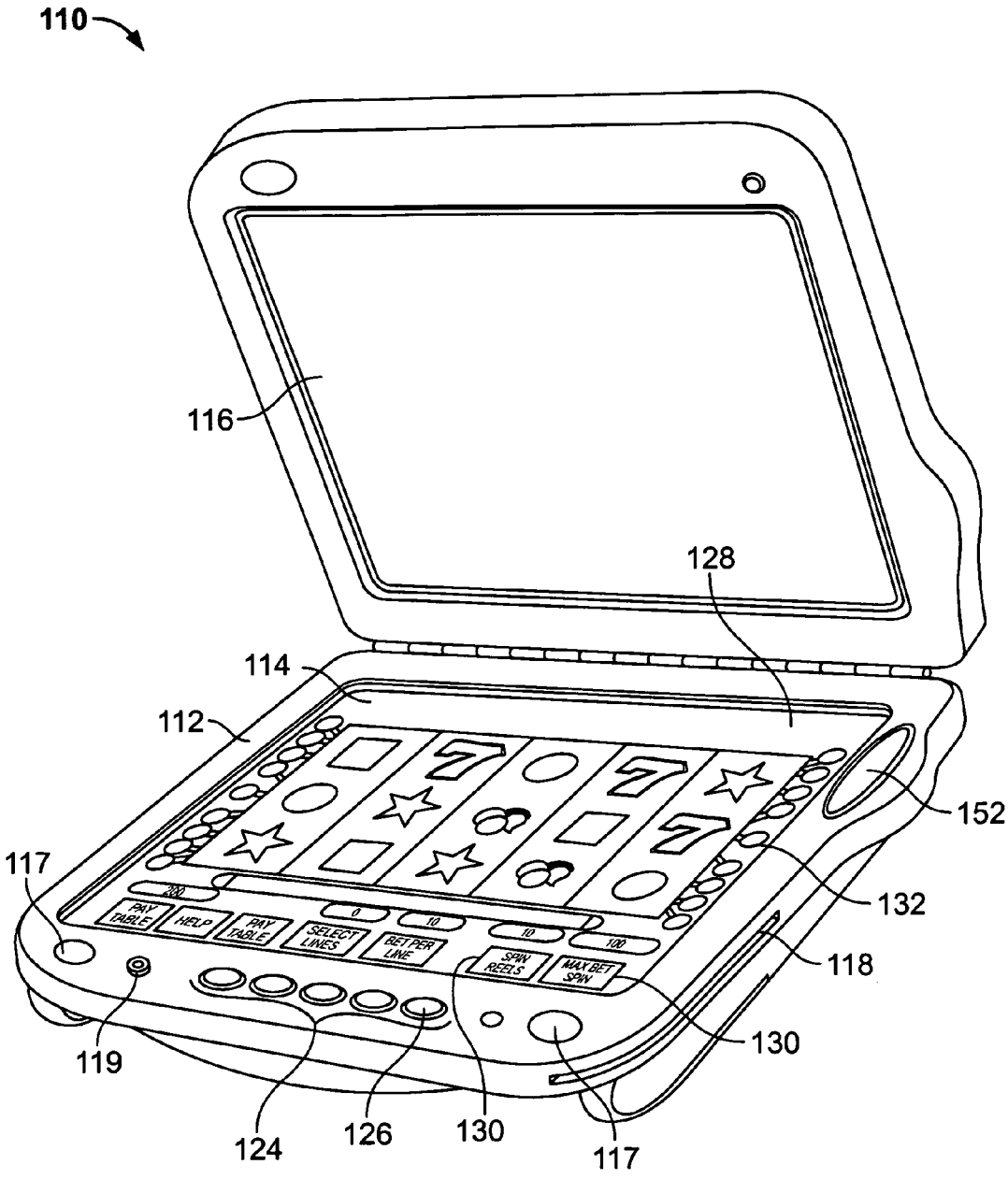
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
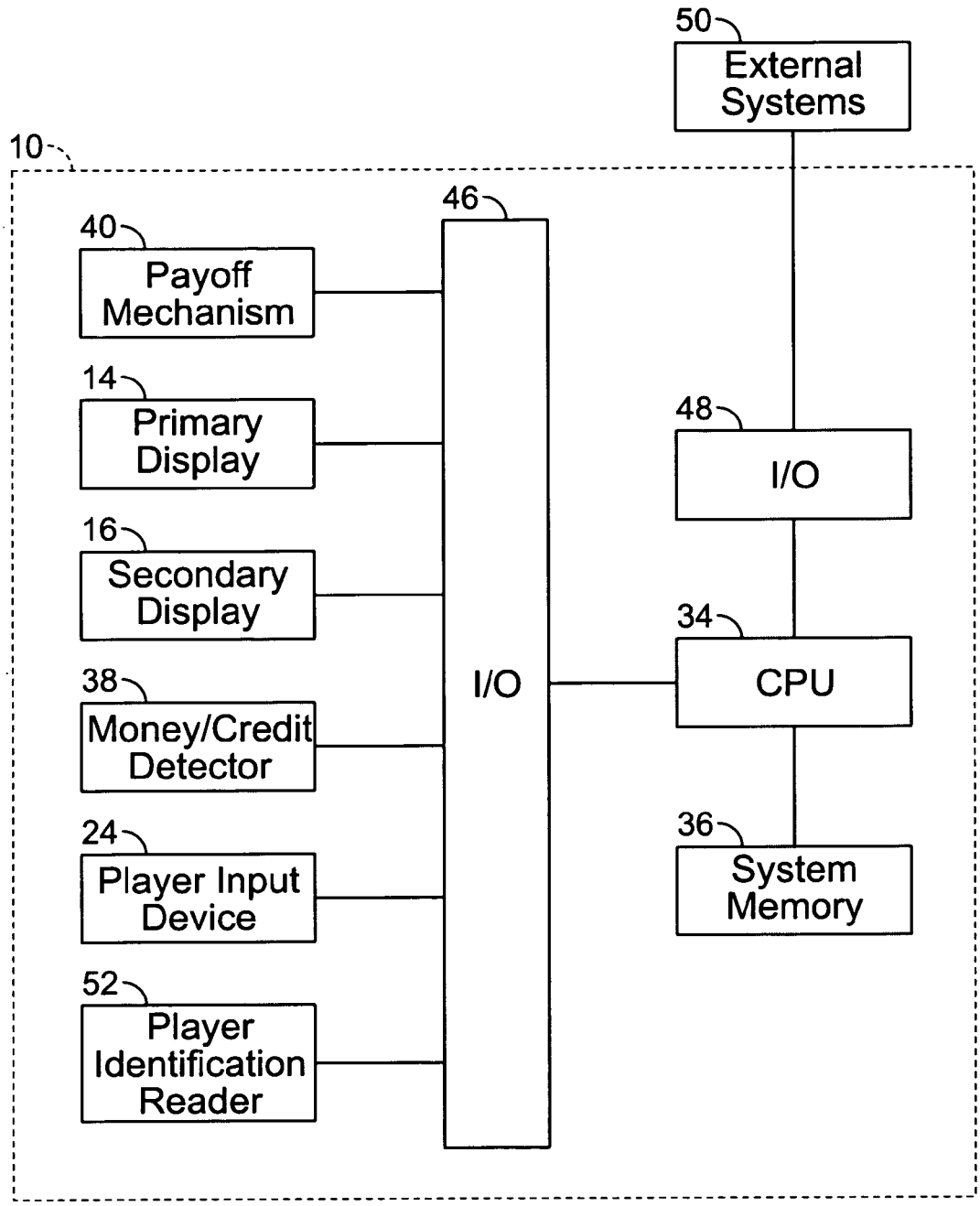
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
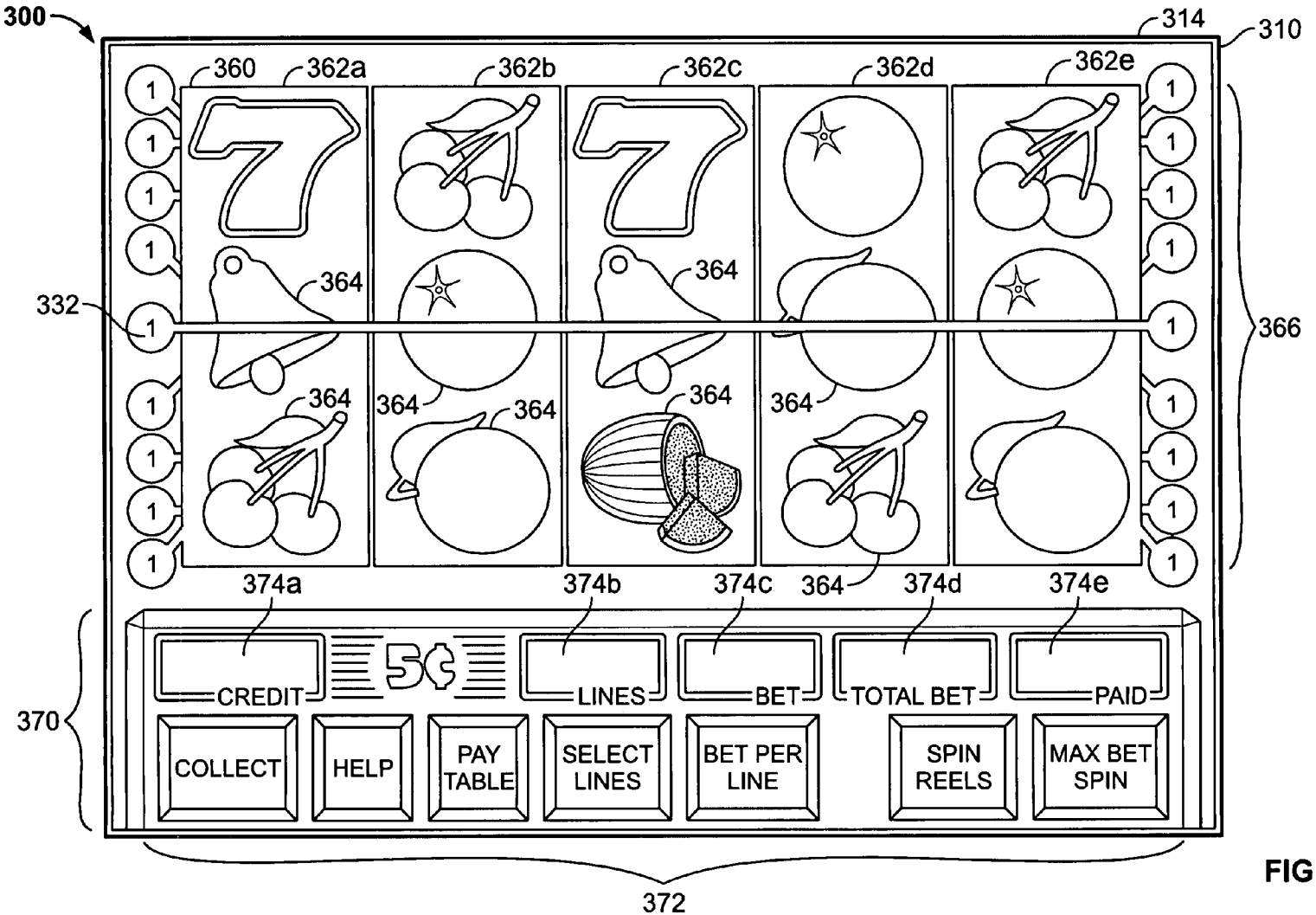
FIG. 3 is a screen shot of a primary display of a gaming system displaying a primary wagering game.

Turning now to FIG. 3, a primary display 314 of a gaming device 310 of a gaming system 300 is shown. The primary display 314 may be any form of display such as those described herein with reference to the free standing and handheld gaming devices of FIGS. 1*a* and 1*b*. The primary display 314 includes a display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon that vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein the symbols 364 landing on the active paylines 332 (the paylines for which a wager has been received) are evaluated for winning combinations. If a winning combination of symbols 364 lands on an active payline 332 a primary award is awarded in accordance with a pay table of the gaming device. The symbols 364 on the reels 362*a,b,c,d,e* form an array 366 or matrix of symbols 364, having a number of rows and columns, which in the embodiment shown is three rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

A control bar 370 appears along the bottom of the display 314 and includes a plurality of input buttons or keys 372 for which inputs are sensed by a touch screen overlying the display 314. Moreover, a plurality of meters 374 are displayed on the control bar 370, including a Credit Meter 374*a*, a Lines Meter 374*b*, a Bet Meter 374*c*, a Total Bet Meter 374*d*, and a Paid Meter 374*e*. The Credit Meter 374*a* displays the number of credits available to a player based upon coin, currency or other value input into the system 300. The Lines Meter 374*b* displays the number of paylines 332 which the player has activated for play. The Bet Meter 374*c* displays the size of the wager that the player is placing (the bet amount in credits) on each activated payline. The Total Bet Meter 374*d* displays the total wager on a single play of the wagering game 360, which is the product of the bet amount in the Bet Meter 374*c* and the number of activated paylines in the Lines Meter 374*b*. The Paid Meter 374*e* displays how many credits, if any, have been awarded to the player as a result of a winning outcome on a single play of the primary wagering game 360. If a winning outcome is achieved, the Paid Meter 374*e* displays the size of the win in credits, after which the credits are transferred to the player's balance in the Credit Meter 374*a*, and the Paid Meter 374*e* is reset to zero for a subsequent play of the primary wagering game 360.

Figure 4:
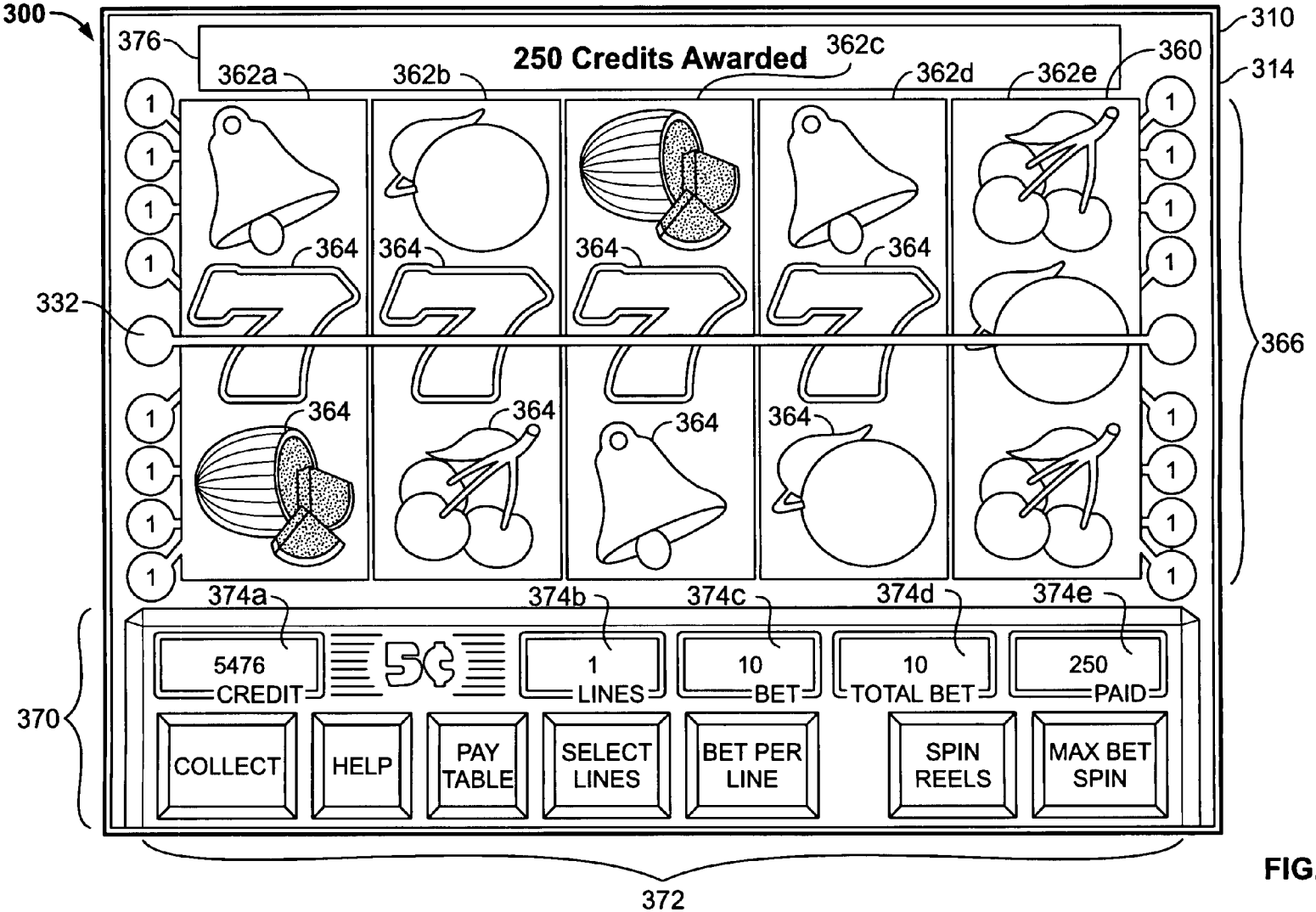
FIG. 4 is a screen shot of the primary wagering game of FIG. 3, displaying a winning outcome.

Turning to FIG. 4, a randomly selected outcome of a play of the primary wagering game 360 is displayed. The reels 362 of the primary wagering game 360 have spun and stopped to display an outcome of the primary wagering game 360 formed by the arrangement of the symbols 364 in the array 366. A single payline 332 was activated on this play of the wagering game 360, as displayed. The player wagered 10 credits per line, and since only one payline was active, the player's total bet was 10 credits, as reflected by the meters 374 on the control bar 370 (the Bet Meter 374*c*). On this particular play of the wagering game 360, a winning outcome has been achieved. The winning outcome in this instance comprises four "7" symbols landing on an active payline 332. In accordance with a paytable of the system 300, the four 7s winning outcome is awarded 250 credits. The award for the winning outcome is displayed in the Paid Meter 374*e*, as well as on a supplemental information banner 376 at the top of the primary display 314, notifying the player of the win and the award amount.

Turning to FIG. 5, a representative paytable 380 of the primary wagering game 360 is displayed. The paytable 380 includes a listing of winning outcomes or combinations 382, corresponding primary award amounts 384, and a column for activating and deactivating a bonus booster feature 386 for selected winning outcomes 382. The paytable 380 is stored in memory accessible to the gaming system 300, where it can be configured by an operator of the system 300. The various winning outcomes 382 and corresponding primary awards 384 in the paytable are programmed such that if and when a randomly selected outcome of the primary wagering game 360 includes a winning outcome 382 occurring or "landing on" an activated payline 332, the corresponding primary award 384 from the paytable 380 is paid to the player as a first award. Thus, as can be seen, the four 7s winning combination 382*a* in the first row of the paytable 380 corresponds with a primary award 384*a* of 250 credits, as seen in FIG. 3 where the winning outcome was achieved on an activated payline 332. The paytable 380 is stored in memory of the gaming system 300 and accessible to one or more controllers used to evaluate outcomes of the primary wagering game 360 for winning combinations 382. As seen in the last column of the paytable 380, an operator of the system 300 can enable the bonus booster feature 386 for certain winning combinations 382, but not others. In this instance, the operator has selected the four 7s and three 7s winning combinations 382 to be eligible for the bonus booster feature 386, as designated by the check marks in that column. Thus, the system 300 can be configured such that some, all, or none of the available winning combinations 382 are activated and made eligible for the bonus booster feature 386.

The bonus booster 386 feature includes a mechanism for randomly selecting an additional, secondary or bonus award 394 amount to be provided to a player, in addition to any primary award 384 amounts for receiving a winning combination 382 in accordance with the paytable 380. In FIGS. 6*a* and 6*b*, two examples of Bonus Booster tables 390*a,b* are displayed, for administering and awarding a secondary award 394*a,b* to the player, in accordance with the bonus booster 386 feature. In FIG. 6*a*, the Bonus Booster Credit Table 390*a* includes a weighting column 392*a*, a plurality of secondary or bonus awards 394*a* in the form of credit amounts, and a percentage column 396*a*. The secondary awards 394*a* include a bonus award of zero credits, and bonus awards of 15, 10, and 20 credits. The weighting column 392*a* and the percentage column 396*a* are related, and signify how often the particular corresponding secondary award 394*a* is awarded through random selection.

As seen in FIG. 6*a*, the sum of the weighting column 392*a* is twelve (12), and each particular secondary award 394*a* is provided a weighting in the table 390*a* relative to the total weighting. Therefore, as seen in the first row of the column, the "zero" credits secondary award 394*a* has a weighting of six (6), and thus it will be awarded randomly six out of twelve times (6/12) or a percentage 396*a* of 50%. Similarly, in the second row of the table 390*a*, the "15 credit" secondary award 394*a* has a weighting of three (3), and thus it will be awarded randomly three out of twelve times (3/12) or a percentage 396*a* of 25%. The rest of the percentages 396*a* in the table 390*a* are calculated in similar fashion. When a secondary award 394*a* of an amount of credits is awarded in accordance with the bonus booster feature as described herein, the credits of the secondary award 394*a* are awarded to the player in addition to the credits of the primary award 384 awarded from the paytable 380.

In FIG. 6*b*, a similar Bonus Booster table is shown which is a Bonus Booster Multiplier Table 390*b*, used in an alternative embodiment of the invention. In the Bonus Booster Multiplier Table 390*b*, the various awards 394*b* are multipliers (instead of credit awards) which are multiplied with (instead of added to) the underlying primary award 384. The weighting column 392*b* and the percentage column 396*b* are identical to the respective columns in the Bonus Booster Credit Table 390*a* of FIG. 6*a*, and function in a similar manner. Thus, when a random selection of a secondary award 394*a* multiplier is made from the Bonus Booster Multiplier Table 390*b*, the random selection is made in accordance with the weightings in the weighting column 392*b* of the table 390*b*. Similarly, statistically the chances of receiving any particular one of the secondary award 394*b* multipliers is given in the percentage column 394*b*.

When the bonus booster 386 is activated, one of the second awards 394*a,b* is selected from the appropriate table 390*a,b*. In an embodiment, one but not both of the tables 390*a,b* are activated at any one time. Assuming only the Bonus Booster Credits table is active, then the booster feature 386 will award credit amounts from the table 390*a* as follows. In an embodiment, an award 394*a* is randomly selected in accordance with the weighting 392*a* in the table. For example, in one embodiment, a number from one (1) to twelve (12) is randomly selected. If the number is one through six (1-6), the first row of the table 390*a* is utilized, and a second award 394*a* of zero credits is awarded to the player. If the number selected is seven (7) through nine (9), the second row of the table 390*a* is utilized, and a second award 394*a* of fifteen (15) credits is awarded to the player. If the number is ten (10) or eleven (11), then the third row of the table 390*a* is utilized, and a second award 394*a* of ten (10) credits is awarded to the player. If the number selected is twelve (12), then the fourth row of the table 390*a* is utilized, and a second award 394*a* of twenty (20) credits is awarded to the player. As can been seen, because the table 390*a* includes a zero award 394*a*, it is possible for the booster feature 386 to be triggered but still yield no bonus or secondary award 394*a* (an award of zero credits) to the player. The amount of the second award 394*a* will be a function of the random selection process as described herein. The Bonus Booster Multiplier Table 390*b* may be used instead of the credits table 390*a*, and the amount of the second award 394*a* (a multiplier) may be selected in a similar fashion. Many other random selection techniques may be utilized to select a second award 394*a* from the tables 390*a,b* in accordance with the weightings 392*a,b* therein.

It should be understood that in alternative embodiments, more than one paytable may be utilized simultaneously. In one embodiment, multiple paytables may be utilized depending upon the size of the primary wager placed by a player. For example, in an embodiment, the Credits column in the paytable of FIG. 6*a* may apply to wagers between 1 and 50 credits, but for wagers between 51 and 100 credits, an alternative improved paytable may be employed having larger credit awards. In the lower wager table (1 to 50 credits), the second row of the table having a weighting of "3" may award 15 credits (as seen in FIG. 6*a*) where as the second row of the higher wager table (51 to 100 credits) having a weighting of "3" may award 22 credits. Each corresponding other row in the table may also have a larger credit award for each other weighting. In this way, the higher wager table incentivizes players to make larger primary wagers to receive even better payouts.

In yet other embodiments, in the various tables, each row in the table may have the same or different weighting than the corresponding row in the other tables. Also, the credit award provided may be different or the same as explained above. In one embodiment, the weighting in the tables remains the same, but the credit amount awarded is larger in each corresponding row. In another embodiment, the higher wager table and the lower wager table have the same credit amounts, but the weightings differ so as to make the higher wager table more attractive to the player. Other configurations may be utilized so as to incentivize a player to place larger wagers. In yet other alternative embodiments, more than one paytable may be utilized based upon the number of available paylines activated by a player.

Figure 7:
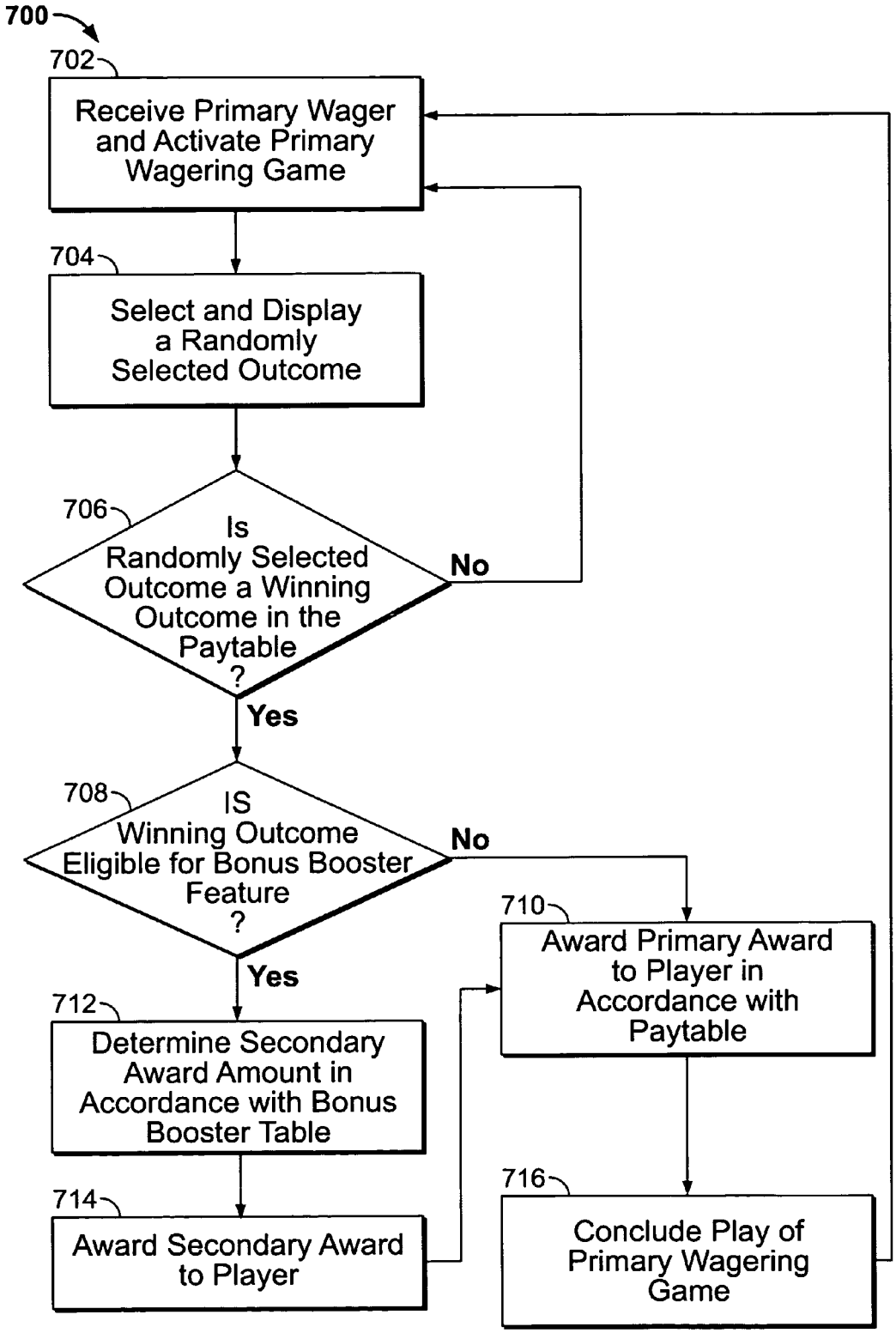
FIG. 7 is a flowchart of a method of operating a wagering game including a bonus booster feature.

Thus, in operation, the bonus booster feature is administered in accordance with the flow chart 700 depicted in FIG. 7. At step 702, a primary wager is received, and the primary wagering game is activated. At step 704, a randomly selected outcome of the wagering game is selected and displayed on the primary display. At step 706, the randomly selected outcome is evaluated to determine if it is a winning outcome in accordance with a paytable of the wagering game. If it is not a winning outcome, the player returns to step 702 to place another wager for a subsequent play of the wagering game. If the randomly selected outcome is a winning outcome, it is evaluated in step 708 to determine if it is a bonus booster eligible winning outcome. In other words, the winning outcome is cross referenced in the paytable to determine whether the operator has activated the bonus booster feature for that particular winning outcome. If the winning outcome is not bonus booster eligible, then in step 710, the player is awarded a first or primary award in accordance with the paytable of the wagering game. If the winning outcome is bonus booster eligible, a second determination is made at step 712 to determine the amount of the secondary or bonus award to be awarded to the player, in accordance with the bonus booster table. At step 714, the secondary or bonus award is awarded to the player and displayed in the paid meter on the primary display, and then the method proceeds to step 710 and awards the primary award in accordance with the paytable. An optional animation or other conveyance of information relating to the secondary or "Bonus Booster" win may be provided to the player as described herein. It should be understood that the first award awarded in step 710 and the second award awarded in step 714 (if any) may be awarded to the player in any order, or simultaneously. At step 716, the play of the wagering game concludes and the player returns to place another wager for a subsequent play of the wagering game. The first or primary award for the winning outcome and the second award for the bonus booster feature, when awarded to the player, are displayed and added to the paid meter on the primary display.

Figure 8A:
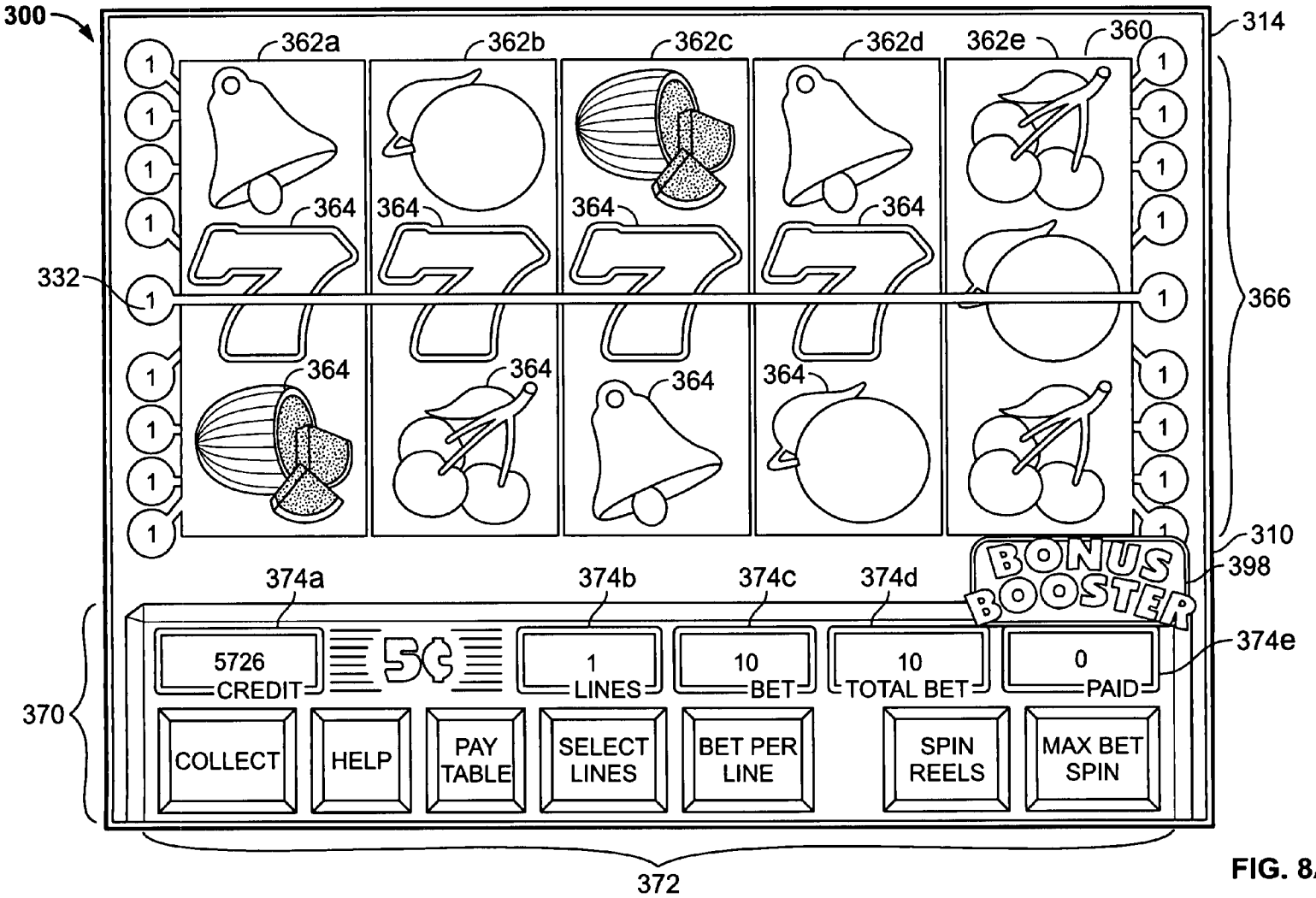
FIG. 8*a* is a screen shot of a primary wagering game displaying another winning outcome, including activation of a bonus booster feature.
Figure 8B:
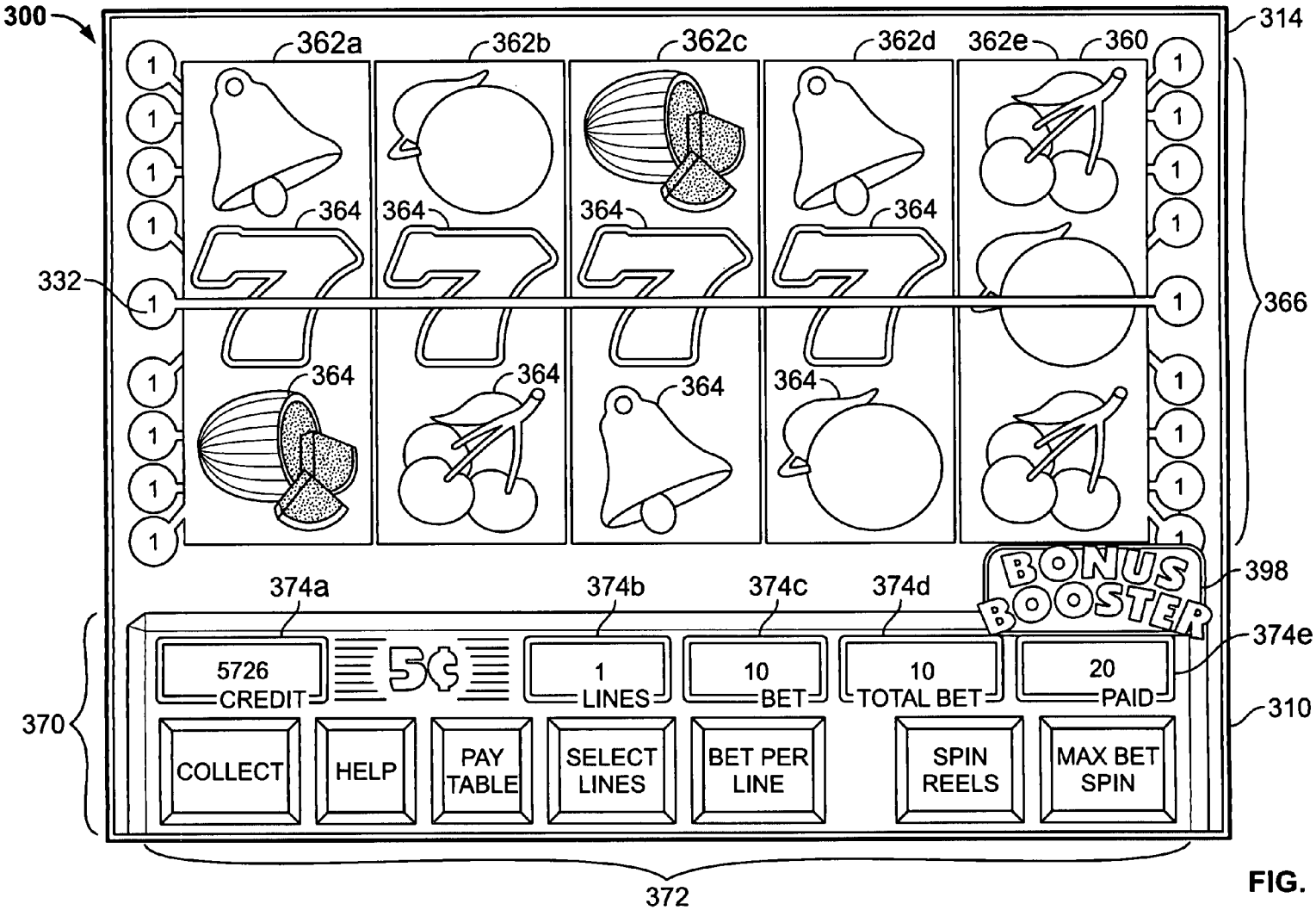
FIG. 8*b* is a screen shot of the primary wagering game of FIG. 8*a*, depicting the bonus booster feature awarding a secondary or bonus award.
Figure 8C:
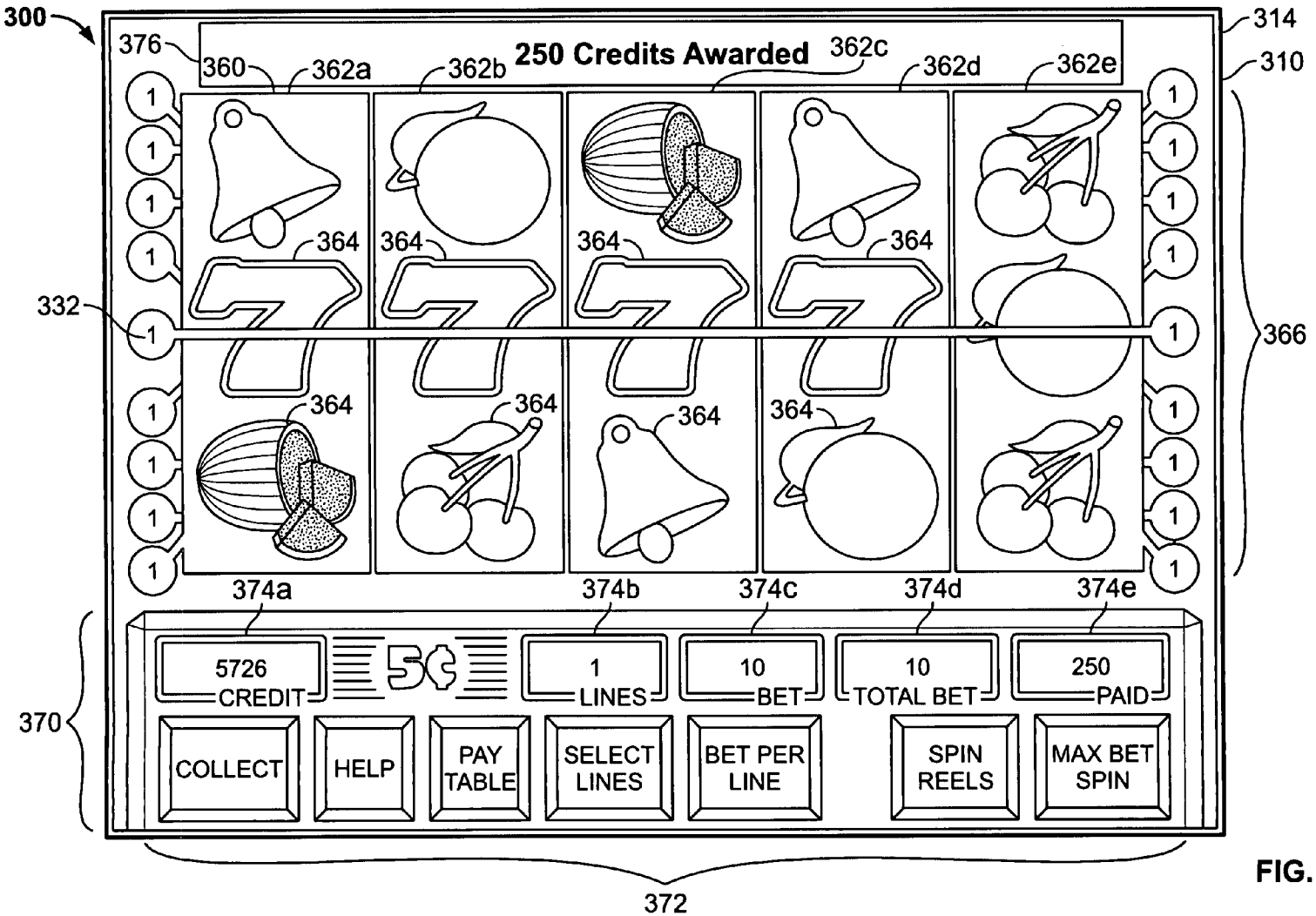
FIG. 8*c* is a screen shot of the primary wagering game of FIG. 8*a*, awarding a primary award in accordance with a paytable.

An example of the execution of the bonus booster feature is displayed in FIGS. 8*a*-8*c*, and described herein. On a subsequent play of the wagering game 360, the player has again wagered ten (10) credits, and activated one payline 332, just as the player did in FIG. 3. The outcome of the primary wagering game 360 includes a winning outcome, which again is the four 7s outcome occurring on the activated payline 332, similar to FIG. 3. In this instance, in accordance with the method shown in FIG. 7, the system 300 determines whether the winning outcome achieved is bonus booster eligible. As shown in the paytable 380 in FIG. 5, the four 7s winning outcome is bonus booster eligible, as signified by the check mark in the last column of the paytable 380. Thus, the operator has configured the system 300 such that the particular winning outcome achieved is bonus booster eligible. Therefore, a secondary determination is made in accordance with the method of FIG. 7. The Bonus Booster Credit Table 390*a* of FIG. 6*a* is utilized and random selection of a secondary or bonus award 394*a* is made. In this instance, the random selection results in a secondary award 394*a* of 20 credits being awarded.

Thus, returning to FIG. 8*a*, because a bonus booster secondary award 394 has been awarded, a Bonus Booster animation 398 appears on the primary display 314, in this instance directly above the Paid Meter 374*e*. The Bonus Booster animation 398 serves to notify the player that the winning outcome has been awarded with a secondary award 394*a* pursuant to the Bonus Booster feature. Turning to FIG. 8*b*, the amount of the secondary award 394*a* of 20 credits is deposited into, and displayed in the Paid Meter 374*e*. The Bonus Booster animation 398 persists to continue to indicate to the player that the 20 credits awarded is the secondary award 394*a*, and part of the Bonus Booster Feature. Turning to FIG. 8*c*, the Bonus Booster animation 398 ceases and is removed from the primary display 314. Then the primary award 384 of 250 credits is awarded to the player. As in FIG. 3, the player is notified regarding the amount of the primary award 384 via the information banner 376 at the top of this display 314. Moreover, the primary award 384 is added to the Paid Meter 374*e* on the primary display 314 such that the Paid Meter 374*e* reflects the total of the secondary award 394*a* of 20 credits plus the primary award 384 of 250 credits, or a total of 270 credits.

In this way, the Bonus Booster Feature performs a secondary determination to determine whether a winning outcome is bonus booster eligible, and if so, the amount of the secondary award 394, if any, to be awarded to the player. During presentation of the awards in the embodiment shown in the FIGURES, the secondary award 394 is provided to the player first, in conjunction with the Bonus Booster animation 398. This notifies the player that this portion of his award is due to the Bonus Booster feature, and not part of the primary award 384 paid in accordance with the paytable 380 for the winning outcome 392. After the Bonus Booster animation 398 is complete, and the secondary award 394*a* is awarded, then the primary award 384 for the winning outcome 392 is awarded to the player in standard fashion, by adding it to the Paid Meter 374*e*, and notifying the player via the information banner 376. Thus, the difference between the display of a winning outcome with a bonus booster award and one without such an award is the intervening presentation of the Bonus Booster animation 398 and the presentation of the amount of the secondary award 394 provided to the player via the Paid Meter 374*e*.

In alternative embodiments, many other presentations may be utilized to provide the primary and secondary awards 384,394. For example, the secondary award 394 may be awarded after the primary award 384, or the two awards 384,394 may be awarded simultaneously. Moreover, the bonus booster secondary award 394 may be banked, stored, or compiled for presentation to the player in other manners, such as the conclusion of a gaming session, or entry into another bonus round, for example. Additionally, it should be understood that the format and inclusion of the Bonus Booster animation 398 and the information display 376 are only examples of presenting and informing the player about the receipt and amount of the secondary award 394 and primary award 384, respectively. Many other graphical, textual, and audio presentations may be used to inform the player as to the type and amount of award he or she has received.

Figure 10:
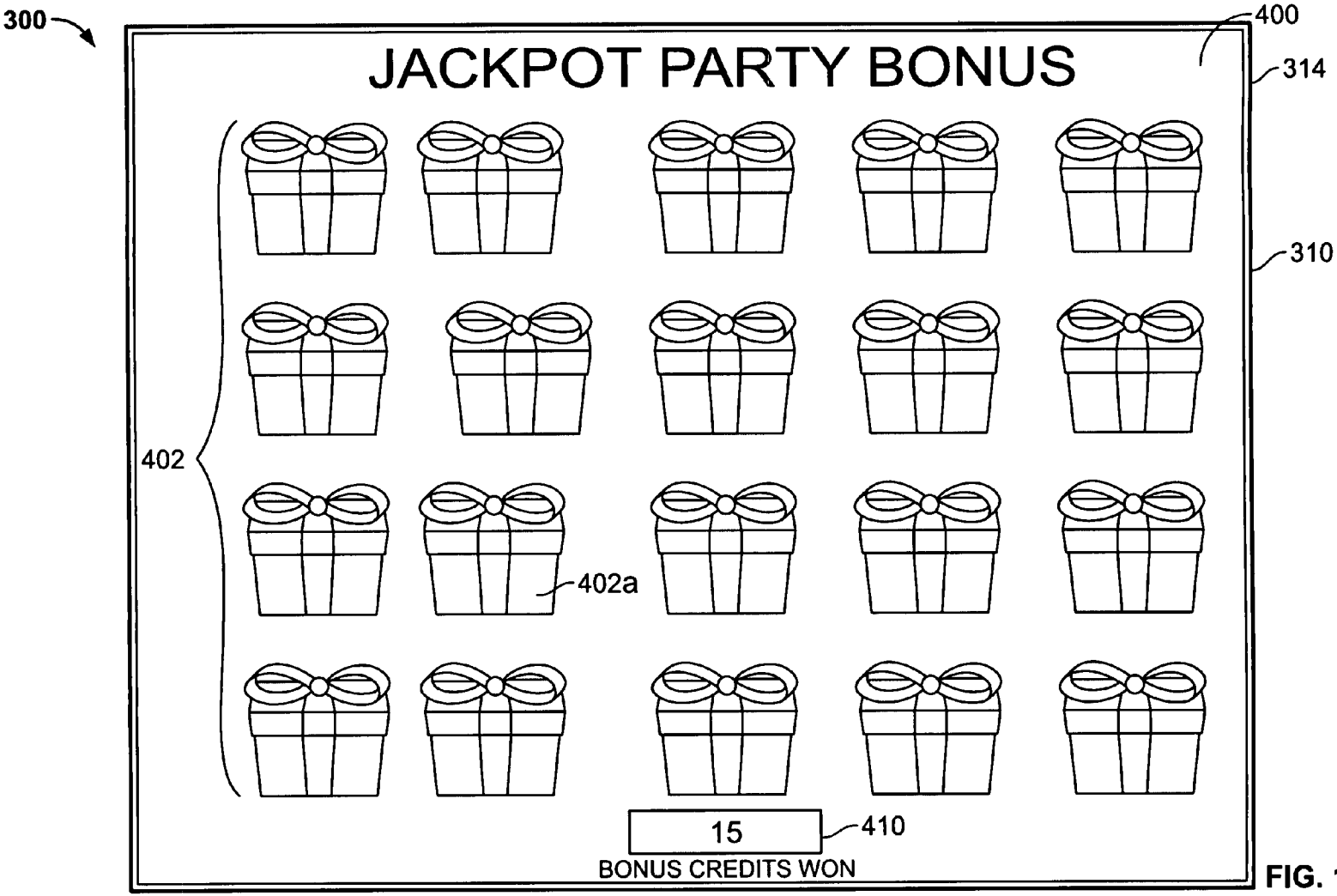
FIG. 10 is a screen shot of the commencement of a secondary wagering game.
Figure 11:
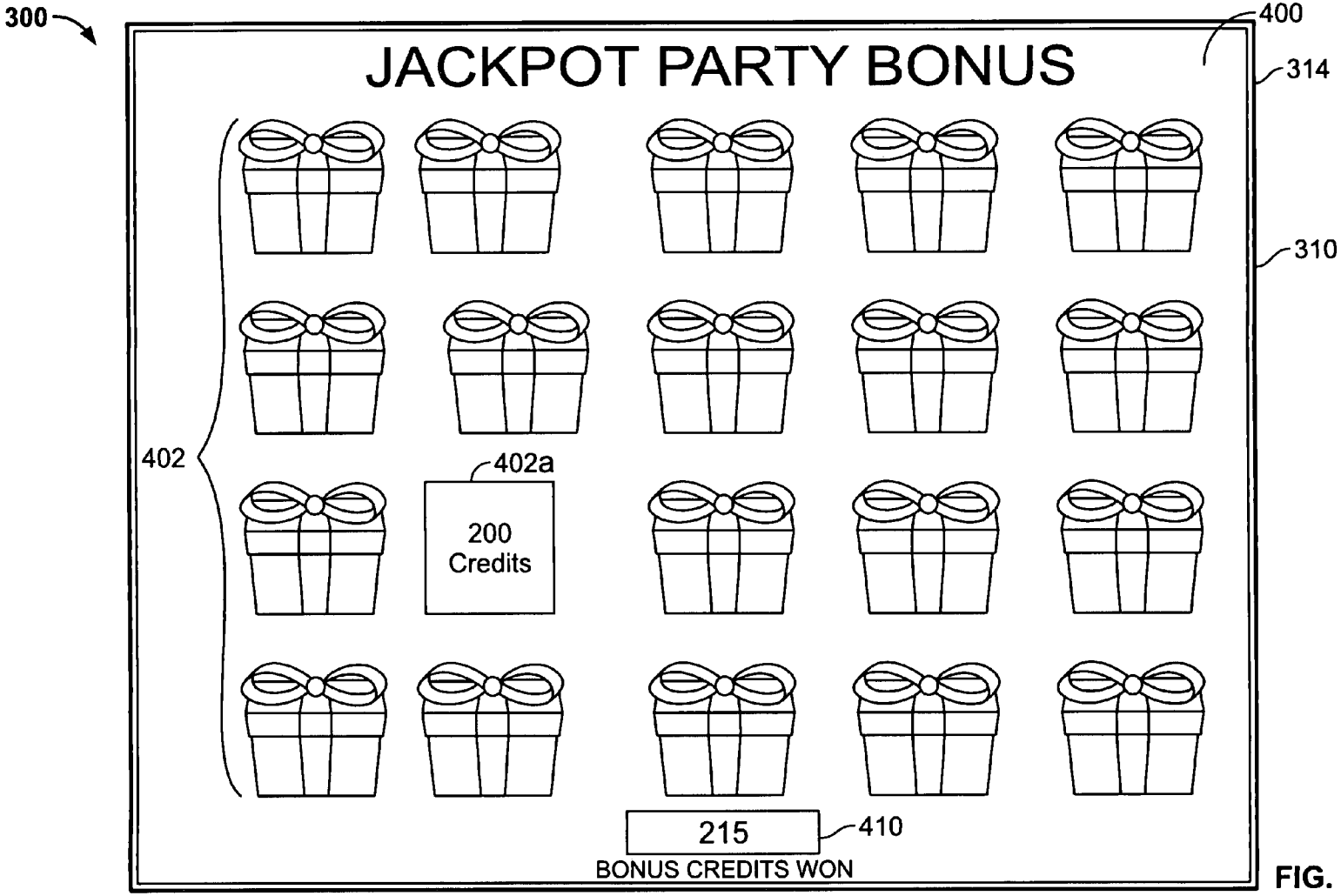
FIG. 11 is a screen shot of further play of the secondary wagering game of FIG. 10.

In FIGS. 9-11, yet another alternative embodiment of the invention is displayed. In an embodiment, one or more of the winning outcomes 382 which are designated as bonus booster eligible in the paytable 380 may be bonus triggering outcomes as well. A bonus triggering outcome is an outcome that triggers a secondary wagering game, such as a bonus round with a picking game, for example. Thus, as seen in FIG. 9, a winning outcome 382 is achieved which is a bonus triggering outcome. In this instance, three "Bonus" symbols have aligned on an active payline 332. As such, a secondary wagering game, entitled "Jackpot Party Bonus" is triggered, as indicated to the player via the information banner 376 on the primary display 314. In addition, as with FIGS. 8*a*-8*c*, because the winning outcome 392 is also Bonus Booster eligible, a secondary determination is again made in accordance with a Bonus Booster Credit Table 390*a*, such as the one in FIG. 6*a*. In this instance, the secondary determination results in a secondary award 394*a* of 15 credits being awarded to the player. The secondary award 394*a*, similar to the example in FIGS. 8*a*-8*c*, is awarded to the player by being displayed in the Paid Meter 374*e*, and being announced to the player via the Bonus Booster animation 398, as seen in FIG. 9.

Turning to FIG. 10, the primary display 314 transitions from the primary wagering game 360 to display a secondary wagering game 400. The secondary wagering game 400 is entitled "Jackpot Party Bonus" and is a picking game where the player is permitted to make selections from a plurality of selectable elements 402 in the form of presents displayed in the primary display 314. The player may be provided a predetermined number of selections from the available selectable elements 402, or may be permitted to continue to make selections from the selectable elements 402 until he or she selects an element 402 that reveals a bonus terminating symbol. At the bottom of the display 314, a Bonus Meter 410 displays 15 credits, which reflects the secondary award 394 of 15 credits won due to the Bonus Booster feature having been activated. Thus, the credits won from the Bonus Booster feature are carried over from the primary wagering game 360 into the secondary wagering game 400, as seen in FIG. 10. In other words, the 15 credits awarded to the player as a secondary award 394 as part of the bonus booster feature is carried over from the Paid Meter 374*e* of the primary wagering game 360 to the Bonus Meter 410 of the secondary wagering game 400. The balance of 15 credits is displayed in the Bonus Meter 410 prior to the player making any selections of the available selectable elements 402.

Turning to FIG. 11, the player has selected a first selectable element 402*a*, which has revealed an award of 200 credits. The 200 credit award is awarded to the player and displayed on the primary display 314. As a result, 200 credits is deposited into the Bonus Meter 410 at the bottom of the display 314. The Bonus Meter 410 is then updated to reflect the balance of the credits won by the player, which in this instance is 215 credits. This comprises the 15 credit secondary award won through the bonus booster feature and carried over into the secondary wagering game 400, plus the 200 credit award won during play of the secondary wagering game 400 by selecting the selectable element 402*a* displayed in FIGS. 10-11. Any further selections made by the player in the secondary wagering game 400 which result in additional credits being awarded to the player would be added to the total credits in the Bonus Meter 410 and awarded to the player upon conclusion of the secondary wagering game 400. Then, in an embodiment, the primary display 314 would transition back to displaying the primary wagering game 360 where the total bonus amount won would be added to the player's balance of credits in the Credit Meter 374*a*. The player would then be permitted to continue play of the primary wagering game 360, by placing another wager and initiating play as described herein.

It should be understood that the secondary wagering game 400 may be displayed on a secondary display separate from the primary display 314, instead of or in addition to being displayed on the primary display 314. Thus, the embodiment shown in FIGS. 9-11 is only one example of a secondary wagering game 400, and many other forms of secondary wagering games may be used, as well as many different types of displays, in conjunction or remote from the primary display 314. Regardless of how such secondary wagering game is displayed, or what form it takes, the balance of the credits earned in the secondary wagering game may be combined with any secondary award 394 provided by the Bonus Booster Feature herein, and awarded to the player, either prior to, during, or after execution of the secondary wagering game. In this way, the Bonus Booster Feature may be implemented so as to be triggered on winning outcomes which also happen to be bonus triggering outcomes.

The system 300 as described and shown in various embodiments herein, offers a number of advantages over traditional systems. Like traditional systems, a random determination of an outcome of a wagering game is made and the randomly selected outcome is presented to the player. If the randomly selected outcome is a winning outcome, a first award is paid in accordance with a paytable. In addition, however, the system provides a bonus booster feature which is activated to add a second award amount to certain winning combinations. The operator of the system 300 can configure the paytable so as to make one or more of the winning combinations eligible for the bonus booster feature. When a winning outcome occurs, if it is eligible for the bonus booster feature, a second award amount is randomly selected and presented to the player. By graphically adding a bonus animation to the display, the player is informed that the credits awarded are bonus credits paid in addition to the credits due for the winning combination. Thus, to the player the system provides a seemingly random extra award which occurs from time to time. This provides the player with added incentive to continue play of the wagering game, in that the player's anticipation of a winning outcome is heightened further by the possibility of receiving the bonus second award.

Each of these embodiments and obvious variations thereof is contemplated as falling within the spirit and scope of the claimed invention, which is set forth in the following claims.

What is claimed is:

1. A gaming system comprising:

a wager input device for receiving a primary wager;

a display for displaying a primary wagering game; and a controller operative to:

(i) detect receipt of the primary wager;

(ii) cause the display to present a randomly selected outcome of the primary wagering game, the randomly selected outcome selected from a plurality of possible outcomes, the plurality of possible outcomes including at least one winning outcome;

(iii) determine if the randomly selected outcome is the at least one winning outcome;

(iv) determine if the at least one winning outcome satisfies a booster eligibility requirement;

(v) in response to the randomly selected outcome being the at least one winning outcome, provide a first award; and (vi) in response to the at least one winning outcome satisfying the booster eligibility requirement, provide a second award.

2. The system of claim 1, wherein the booster eligibility requirement comprises the at least one winning outcome being designated as booster eligible.

3. The system of claim 2, wherein the booster eligibility requirement further comprises the primary wager being greater than or equal to a minimum wager amount.

4. The gaming system of claim 2, wherein the booster eligibility requirement further comprises a predetermined number of paylines being activated in the primary wagering game.

5. The gaming system of claim 1, wherein the second award is a multiplier which is multiplied with the first award, the multiplier being greater than or equal to one.

6. The gaming system of claim 5, wherein the multiplier is randomly selected from a weighted table of available multipliers.

7. The gaming system of claim 1, wherein the second award is a credit amount which is added to the first award, the credit amount being randomly selected from a weighted table of available credit amounts.

8. The gaming system of claim 7, wherein the weighted table is selected from a plurality of available weighted tables dependent upon the amount of the primary wager.

9. A method of operating a wagering game comprising:

receiving a primary wager via an input device;

displaying on a wagering game machine display a randomly selected outcome of a primary wagering game, the randomly selected outcome selected from a plurality of possible outcomes by a controller, the plurality of possible outcomes including at least one winning outcome;

evaluating, by the controller, if the randomly selected outcome is the at least one winning outcome;

evaluating, by the controller, if the at least one winning outcome satisfies a booster eligibility requirement;

providing a first award in response to the randomly selected outcome being the at least one winning outcome; and providing a second award in response to the at least one winning outcome satisfying the booster eligibility requirement.

10. The method of claim 9, wherein the booster eligibility requirement is selected from the group consisting of (i) the at least one winning outcome being designated as booster eligible; (ii) the primary wager being greater than or equal to a minimum wager amount; and (iii) a predetermined number of paylines being activated in the primary wagering game.

11. The method of claim 9, wherein the second award is a credit amount which is added to the first award, the credit amount being selected from a weighted table of available credit amounts.

12. The method of claim 11, wherein the weighted table is selected from a plurality of available weighted tables dependent upon the amount of the primary wager.

13. The method of claim 11, wherein one of the available credit amounts is zero.

14. The method of claim 11, wherein the second award is randomly selected.

15. A method of operating a wagering game comprising:

receiving a primary wager via an input device;

displaying on a display a randomly selected outcome of a primary wagering game, the randomly selected outcome selected from a plurality of possible outcomes by a controller, the plurality of possible outcomes including at least one winning outcome;

providing a first award in response to the randomly selected outcome being the at least one winning outcome, the first award associated with the at least one winning outcome in a first paytable of the wagering game; and activating a bonus booster feature to provide a second award in response to the at least one winning outcome satisfying a booster eligibility requirement, the second award randomly selected from a second paytable of the wagering game.

16. The method of claim 15, wherein the second paytable comprises a weighted table of available credit amounts, one of the available credit amounts being zero.

17. The method of claim 16, wherein the second paytable is selected from a plurality of available second paytables dependent upon the amount of the primary wager.

18. The method of claim 15, further comprising displaying a booster animation on the display.

19. The method of claim 18, wherein the second award is provided during display of the booster animation.

20. One or more non-transitory computer readable storage media encoded with instructions for performing, upon execution by a controller operatively associated with a gaming system configured to conduct a wagering game, a method of operating a wagering game comprising the acts of:

registering receipt of a primary wager to conduct the primary wagering game on the gaming system;

displaying, on a display device associated with the gaming system, a randomly selected outcome of the primary wagering game, the randomly selected outcome selected by the controller from a plurality of possible outcomes including at least one winning outcome;

providing a first award in response to the randomly selected outcome being the at least one winning outcome, the first award associated with the at least one winning outcome in a first paytable of the primary wagering game; and activating a bonus booster feature to provide a second award in response to the at least one winning outcome satisfying a booster eligibility requirement, the second award randomly selected from a second paytable of the primary wagering game.

* * * * *

UNITED STATES PATENT AND TRADEMARK OFFICE

CERTIFICATE OF CORRECTION

PATENT NO. : 8,696,437 B2
APPLICATION NO. : 12/670326
DATED : April 15, 2014
INVENTOR(S) : Anderson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this
Twenty-ninth Day of September, 2015

Michelle K. Lee

Michelle K. Lee
*Director of the United States Patent and Trademark Office*